US009427977B2

(12) United States Patent
Horiuchi

(10) Patent No.: US 9,427,977 B2
(45) Date of Patent: Aug. 30, 2016

(54) INK-JET RECORDING APPARATUS THAT ENSURES ACCURATE POSITION DETECTION OF WIDTHWISE END PORTION OF RECORDING MEDIUM

(71) Applicant: KYOCERA Document Solutions Inc., Osaka (JP)

(72) Inventor: Nobuhiro Horiuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/794,422

(22) Filed: Jul. 8, 2015

(65) Prior Publication Data

US 2016/0016417 A1 Jan. 21, 2016

(30) Foreign Application Priority Data

Jul. 17, 2014 (JP) ..... 2014-146530

(51) Int. Cl.
*B41J 11/00* (2006.01)
*B41J 2/01* (2006.01)

(52) U.S. Cl.
CPC ..... *B41J 11/003* (2013.01); *B41J 2/01* (2013.01); *B41J 11/007* (2013.01); *B41J 11/0095* (2013.01)

(58) Field of Classification Search
CPC ..... B41J 11/003; B41J 11/007
See application file for complete search history.

(56) References Cited

U.S. PATENT DOCUMENTS

2004/0130093 A1 7/2004 Chen et al. ..... 271/264
2007/0046720 A1* 3/2007 Konno ..... B41J 11/002 347/21
2007/0138416 A1 6/2007 Ohta et al. ..... 250/548
2012/0092407 A1 4/2012 Hamada ..... 347/16
2012/0099884 A1* 4/2012 Nakaie ..... G03G 15/5062 399/74

FOREIGN PATENT DOCUMENTS

JP 2005-43195 A 2/2005
JP 2007-168975 A 7/2007
JP 2009-113231 A 5/2009
JP 2012-86921 A 5/2012

OTHER PUBLICATIONS

Japanese Office Action issued by the Japanese Patent Office, dated Apr. 12, 2016, in corresponding application JP 2014-146530.

* cited by examiner

*Primary Examiner* — Kristal Feggins
*Assistant Examiner* — Kendrick Liu
(74) *Attorney, Agent, or Firm* — Stein IP, LLC

(57) ABSTRACT

An ink-jet recording apparatus includes a belt conveying unit, a recording unit, an end-portion position detection sensor, a background member, and a rotary driving unit. The end-portion position detection sensor is arranged in an upstream of the belt conveying unit in a recording medium conveyance direction, and uses a reflected light to detect a position of an end portion of the recording medium in a recording medium width direction intersecting with the recording medium conveyance direction. The background member is arranged facing a detection surface of the end-portion position detection sensor. The background member is rotatable around a shaft extending along the recording medium width direction. The background member has an outer peripheral surface at least in a region facing the detection surface of the end-portion position detection sensor. The outer peripheral surface has two or more regions having mutually different colors circumferentially dividing the outer peripheral surface.

1 Claim, 9 Drawing Sheets

INK-JET RECORDING APPARATUS THAT ENSURES ACCURATE POSITION DETECTION OF WIDTHWISE END PORTION OF RECORDING MEDIUM

INCORPORATION BY REFERENCE

This application is based upon, and claims the benefit of priority from, corresponding Japanese Patent Application No. 2014-146530 filed in the Japan Patent Office on Jul. 17, 2014, the entire contents of which are incorporated herein by reference.

BACKGROUND

Unless otherwise indicated herein, the description in this section is not prior art to the claims in this application and is not admitted to be prior art by inclusion in this section.

Recording apparatuses such as a facsimile, a copier, and a printer are configured to record an image on a recording medium such as a paper, a cloth, and an OHP sheet, and can be categorized into an inkjet system, a wire dot system, a thermal system, and similar system depending on the recording system. Furthermore, inkjet recording systems can be categorized into a serial type and a line head type. In the serial type, recording is performed while a recording head scans a recording medium. In the line head type, recording is performed by a recording head secured to the apparatus main body.

When a recording medium is printed using the recording apparatus, the recording medium displaced in the direction (the recording medium width direction) perpendicular to the conveyance direction causes displacement of the printing position for each recording medium. Accordingly, for the case of bookbinding after printing, the printing position accuracy for each page is required to be high. In particular, when an ink-jet recording apparatus is used, the ink is likely to soak into the recording medium such that a back copy occurs. Accordingly, a higher accuracy (for example, zero point several mm or less) is required in the printing position accuracy during duplex printing.

Therefore, a typically-used image forming apparatus includes an end-portion position detection sensor on a conveyance belt to convey a paper sheet (recording medium). The end-portion position detection sensor detects the positions of the widthwise end portions of the paper sheet using reflected lights. In this image forming apparatus, the positions of the widthwise end portions of the paper sheet are detected based on the intensity difference between the reflected light from the conveyance belt and the reflected light from the paper sheet.

Here, another disclosed image forming apparatus includes an end-portion position detection sensor, which detects the positions of the widthwise end portions of the paper sheet, on the conveyance belt to convey the paper sheet.

SUMMARY

An ink-jet recording apparatus according to one aspect of the disclosure includes a belt conveying unit, a recording unit, an end-portion position detection sensor, a background member, and a rotary driving unit. The belt conveying unit includes a conveyance belt to convey a recording medium. The recording unit is arranged facing the belt conveying unit. The recording unit discharges ink to the recording medium conveyed by the belt conveying unit. The end-portion position detection sensor is arranged in an upstream of the belt conveying unit in a recording medium conveyance direction. The end-portion position detection sensor uses a reflected light to detect a position of an end portion of the recording medium in a recording medium width direction intersecting with the recording medium conveyance direction. The background member is arranged facing a detection surface of the end-portion position detection sensor. The background member is rotatable around a shaft extending along the recording medium width direction. The rotary driving unit rotates the background member. The background member has an outer peripheral surface at least in a region facing the detection surface of the end-portion position detection sensor. The outer peripheral surface has two or more regions having mutually different colors circumferentially dividing the outer peripheral surface.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
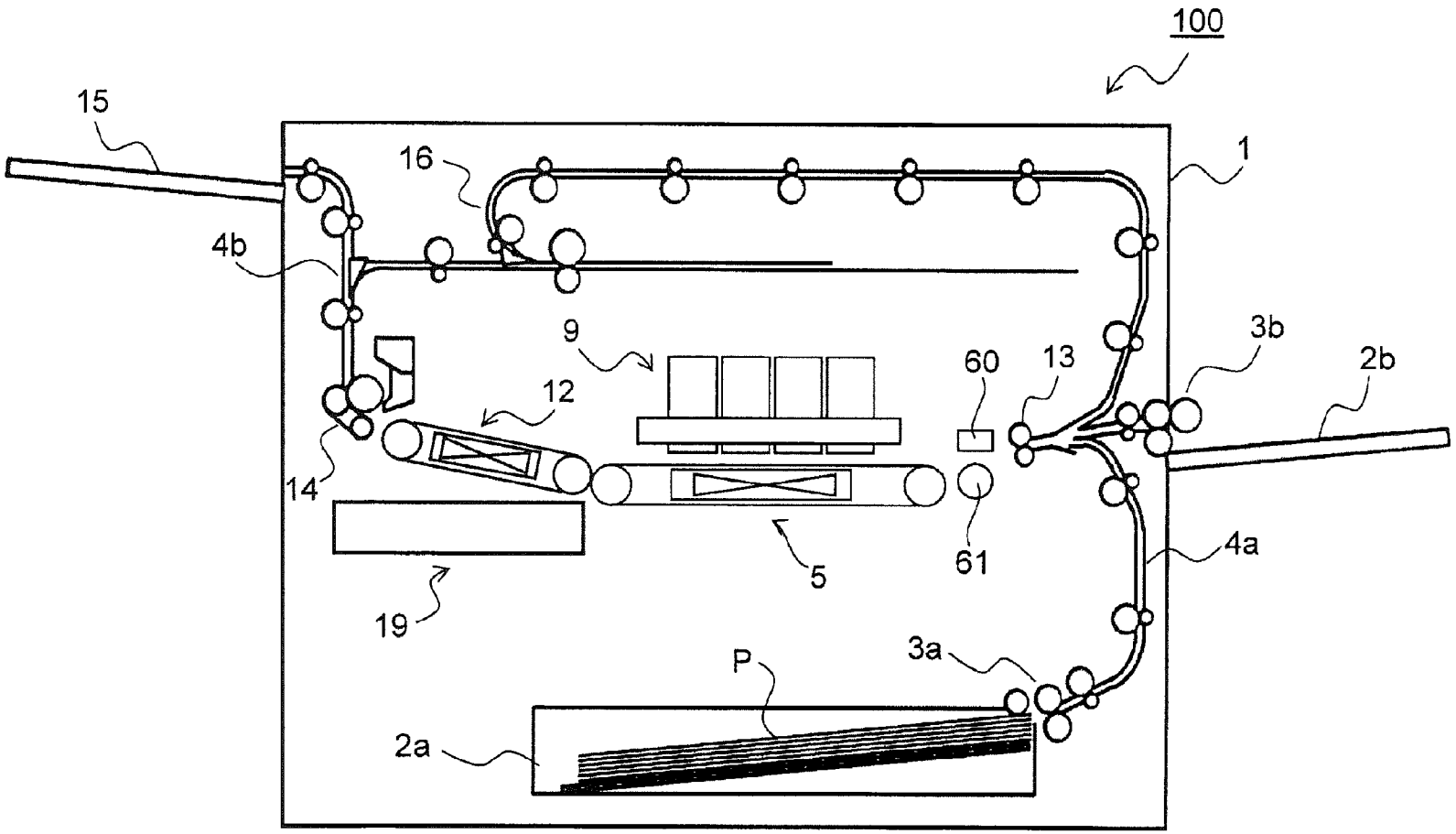
FIG. 1 illustrates a schematic structure of a printer according to one embodiment of the disclosure in a cross section.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure with reference to the drawings.

As illustrated in FIG. 1, a printer (ink-jet recording apparatus) 100 includes a sheet feed cassette 2*a* as a paper-sheet housing portion arranged in a lower portion inside a printer main body 1. Inside the sheet feed cassette 2*a*, a predetermined count (for example, about 500 sheets) of paper sheets P such as cut papers before being printed as one example of a recording medium are loaded and housed. In the downstream of the sheet feed cassette 2*a* in the paper sheet conveyance direction, that is, on the upper right of the sheet feed cassette 2*a* in FIG. 1, a paper feeder 3*a* is arranged. This paper feeder 3*a* feeds the paper sheets P separately one by one toward the upper right of the sheet feed cassette 2*a* in FIG. 1. The sheet feed cassette 2*a* can be horizontally drawn from the front side of the printer main body 1 to replenish the paper sheets P.

Outside the right-side surface of the printer main body 1, a manual paper feed tray (recording medium loading portion) 2*b* is located. On the manual paper feed tray 2*b*, a paper sheet having a size different from that of the paper sheet P inside the sheet feed cassette 2*a*, a recording medium that has difficulty in passing through a curved conveying path, for example, a cardboard, an OHP sheet, an envelope, an postcard, and an invoice, a recording medium desired to be fed one by one by hand, or similar recording medium is placed. In the downstream of the manual paper feed tray 2*b* in the paper sheet conveyance direction, that is, on the left side of the manual paper feed tray 2*b* in FIG. 1, a paper feeder 3*b* is arranged. This paper feeder 3*b* feeds the paper sheets on the manual paper feed tray 2*b* separately one by one toward the left side in FIG. 1.

The printer 100 internally includes a first paper sheet conveyance passage 4*a*. The first paper sheet conveyance passage 4*a* is positioned on the upper right, which is the paper feeding direction, of the sheet feed cassette 2*a*, and is positioned on the left side of the manual paper feed tray 2*b*. The first paper sheet conveyance passage 4*a* conveys: the paper sheet P fed from the sheet feed cassette 2*a* perpendicularly upward along the side surface of the printer main body 1, and the paper sheet fed from the manual paper feed tray 2*b* approximately horizontally leftward.

In the downstream end of the first paper sheet conveyance passage 4*a* in the paper sheet conveyance direction, a registration roller pair 13 is located. Additionally, in the downstream of the registration roller pair 13 in the paper sheet conveyance direction, a first belt conveying unit 5 and a recording unit 9 are arranged. The paper sheet P fed from the sheet feed cassette 2*a* (or the manual paper feed tray 2*b*) reaches the registration roller pair 13 passing through the first paper sheet conveyance passage 4*a*. The registration roller pair 13 corrects oblique feeding of the paper sheet P and feeds the paper sheet P toward the first belt conveying unit 5 taking into consideration the timing of the ink discharging operation executed by the recording unit 9. Here, in the first paper sheet conveyance passage 4*a*, conveyance roller pairs for conveying the paper sheet P are located in appropriate positions.

Between the registration roller pair 13 and the first belt conveying unit 5, an end-portion position detection sensor 60 and a background member 61 for detecting the positions of the end portions of the paper sheet P in the width direction (the perpendicular direction with respect to the paper sheet conveyance direction) are arranged. The detailed structure in the vicinity of the end-portion position detection sensor 60 and the background member 61 will be described later.

Figure 2:
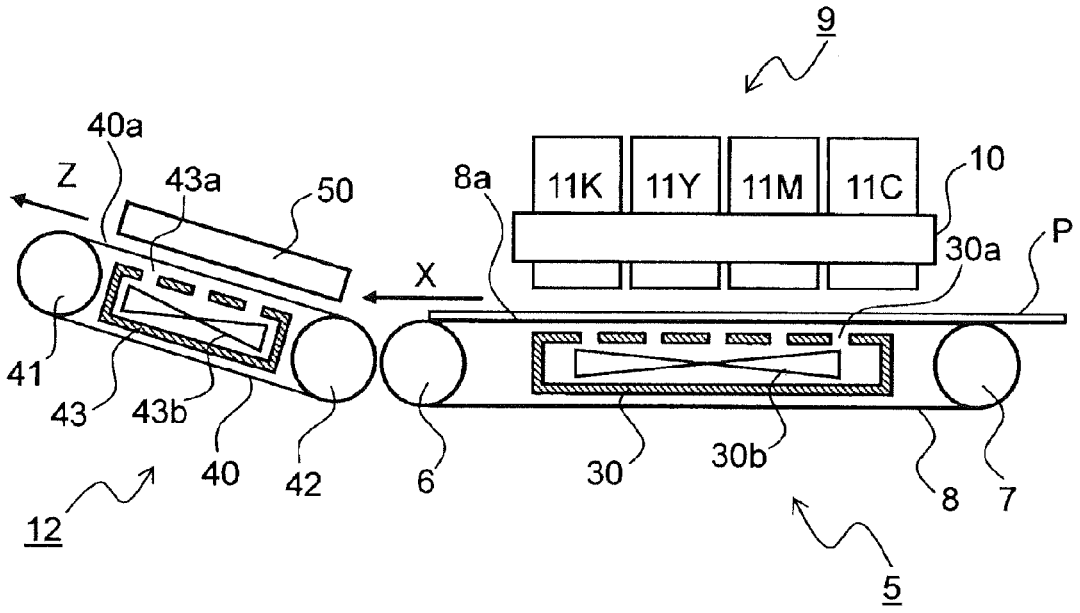
FIG. 2 illustrates a structure in a vicinity of a first belt conveying unit, a recording unit, and a second belt conveying unit of the printer according to the one embodiment in a cross section.

As illustrated in FIG. 2, the first belt conveying unit 5 includes an endless first conveyance belt 8 wound around a first drive roller 6 and a first driven roller 7. The first conveyance belt 8 is rotated in the anticlockwise direction in FIG. 2 by the first drive roller 6. The paper sheet P fed by the registration roller pair 13 is held to a conveying surface 8*a* (the top surface of the first conveyance belt 8 in FIG. 2) of the first conveyance belt 8 and conveyed in the arrow X direction (from the right side to the left side) in FIG. 2.

In the portion facing the back side of the conveying surface 8*a* of the first conveyance belt 8 on the inner side of the first conveyance belt 8, a first paper-sheet sucking unit 30 is located. The first paper-sheet sucking unit 30 includes multiple holes 30*a* for sucking air on its top surface and internally includes a fan 30*b*, so as to suck air from the top surface to the lower side. The first conveyance belt 8 also includes multiple ventholes 8*b* (see FIG. 7) for sucking air. With the above-described configuration, the first belt conveying unit 5 conveys the paper sheet P while sucking and holding the paper sheet P on the conveying surface 8*a* of the first conveyance belt 8.

The recording unit 9 includes line heads 11C, 11M, 11Y, and 11K, which record an image on the paper sheet P conveyed while being sucked and held to the conveying surface 8*a*. Corresponding to the information of the image data received from an external computer or similar device, respective inks are sequentially discharged from the respective line heads 11C to 11K toward the paper sheet P, which is conveyed while being sucked to be held on the first conveyance belt 8 and, so as to record a full-color image, in which inks in four colors of yellow, magenta, cyan, and black are superimposed, on the paper sheet P. Here, the printer 100 can also record a monochrome image.

Here, the discharge system of inks from the recording heads 17*a* to 17*c* can employ various systems of, for example, a piezo system, which extrudes ink using a piezo element (not illustrated), and a thermal inkjet system, which causes a heating element to generate air bubbles and applies pressure to discharge ink.

In the downstream (the left side in FIG. 1) of the first belt conveying unit 5 in the paper sheet conveyance direction, a second belt conveying unit 12 is arranged. The paper sheet P having an ink image recorded by the recording unit 9 is fed to the second belt conveying unit 12, and the ink discharged onto the surface of the paper sheet P is dried while passing through the second belt conveying unit 12.

The second belt conveying unit 12 includes an endless second conveyance belt 40 wound around a second drive roller 41 and a second driven roller 42. The second conveyance belt 40 is rotated in the anticlockwise direction in FIG. 2 by the second drive roller 41. The paper sheet P, having an image recorded by the recording unit 9 and conveyed in the arrow X direction by the first belt conveying unit 5, is delivered to the second conveyance belt 40 and conveyed in the arrow Z direction in FIG. 2.

In the portion facing the back side of a conveying surface 40*a* of the second conveyance belt 40 on the inner side of the second conveyance belt 40, a second paper-sheet sucking unit 43 is located. The second paper-sheet sucking unit 43 includes multiple holes 43*a* for sucking air on its top surface and internally includes a fan 43*b*, so as to suck air from the top surface to the lower side. The second conveyance belt 40 also includes multiple ventholes (not illustrated) for sucking air. With the above-described configuration, the second belt conveying unit 12 conveys the paper sheet P while sucking and holding the paper sheet P on the conveying surface 40*a* of the second conveyance belt 40.

In the position facing the conveying surface 40*a* of the second conveyance belt 40, a conveyance guiding portion 50 is located. The conveyance guiding portion 50 constitutes a sheet conveying path together with the conveying surface 40*a* of the second conveyance belt 40, and reduces warping and fluttering of the paper sheet P sucked and held to the conveying surface 40*a* by the second paper-sheet sucking unit 43.

In the downstream of the second belt conveying unit 12 in the paper sheet conveyance direction and adjacent to the left side surface of the printer main body 1, a decurler unit 14 is located. The paper sheet P where the ink has been dried by the second belt conveying unit 12 is fed to the decurler unit 14. Then, the curling caused in the paper sheet P is corrected using a plurality of rollers aligned in the paper sheet width direction.

In the downstream (on the upper side in FIG. 1) of the decurler unit 14 in the paper sheet conveyance direction, a second paper sheet conveyance passage 4*b* is located. When duplex recording is not performed, the paper sheet P having passed through the decurler unit 14 is discharged onto a paper-sheet discharge tray 15, which is located outside the left side surface of the printer 100, from the second paper sheet conveyance passage 4*b* via a discharge roller pair.

Under the second belt conveying unit 12, a maintenance unit 19 is arranged. When performing purge, the maintenance unit 19 moves under the recording unit 9 to wipe the ink discharged from ink discharge nozzles 18 (see FIG. 3) of the recording heads 17*a* to 17*c* and recover the wiped ink.

In the upper portion of the printer main body 1 and over the recording unit 9 and the second belt conveying unit 12, a reverse conveyance path 16 for performing duplex recording is located. When duplex recording is performed, the paper sheet P having passed through the second belt conveying unit 12 and the decurler unit 14 after the termination of recording on a first surface is fed to the reverse conveyance path 16 through the second paper sheet conveyance passage 4*b*. Then, the conveyance direction of the paper sheet P fed to the reverse conveyance path 16 is switched for recording on a second surface, and the paper sheet P is fed rightward while passing through the upper portion of the printer main body 1. The paper sheet P is fed to the first belt conveying unit 5 again in the state where the second surface faces upward through the first paper sheet conveyance passage 4*a* and the registration roller pair 13. Here, in the second paper sheet conveyance passage 4*b* and the reverse conveyance path 16, conveyance roller pairs for conveying the paper sheet P are located in appropriate positions, similarly to the first paper sheet conveyance passage 4*a*.

Figure 3:
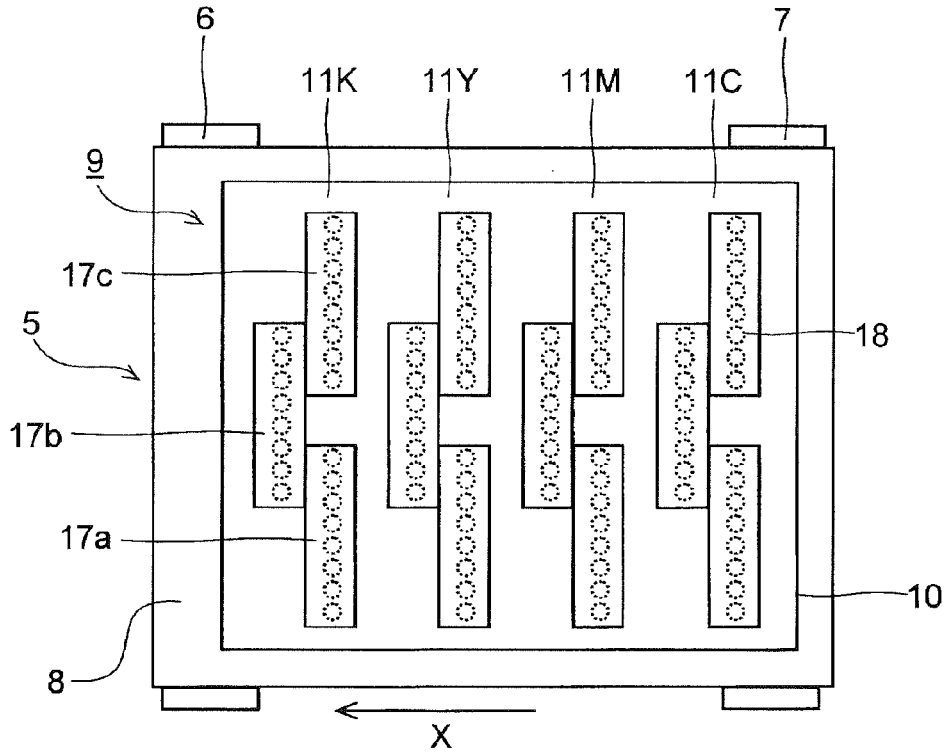
FIG. 3 illustrates the first belt conveying unit and the recording unit of the printer according to the one embodiment in a planar surface from an upper side.
Figure 4:
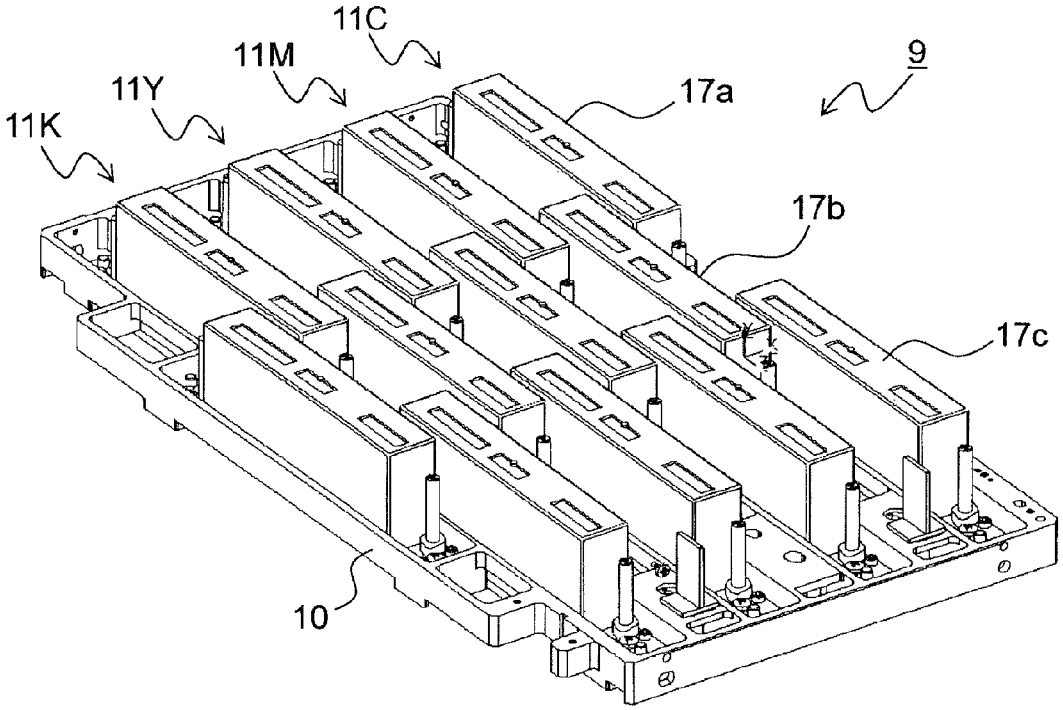
FIG. 4 illustrates the recording unit of the printer according to the one embodiment from an obliquely upper side.

The recording unit 9 includes a head housing 10 and line heads 11C, 11M, 11Y and 11K held in the head housing 10 as illustrated in FIGS. 3 and 4. These line heads 11C to 11K are supported at a height where a predetermined interval (for example, 1 mm) is formed with respect to the conveying surface 8*a* of the first conveyance belt 8. In these line heads 11C to 11K, a plurality (here, three) of the recording heads 17*a* to 17*c* are arrayed in staggered manner along the paper sheet width direction (the above-below direction in FIG. 3) perpendicular to the paper sheet conveyance direction. The line heads 11C to 11K have the recording region of equal to or more than the width of paper sheet P to be fed. The line heads 11C to 11K can discharge ink on the paper sheet P conveyed on the first conveyance belt 8 from an ink discharge nozzle 18 that corresponds to the printing position.

Figure 5:
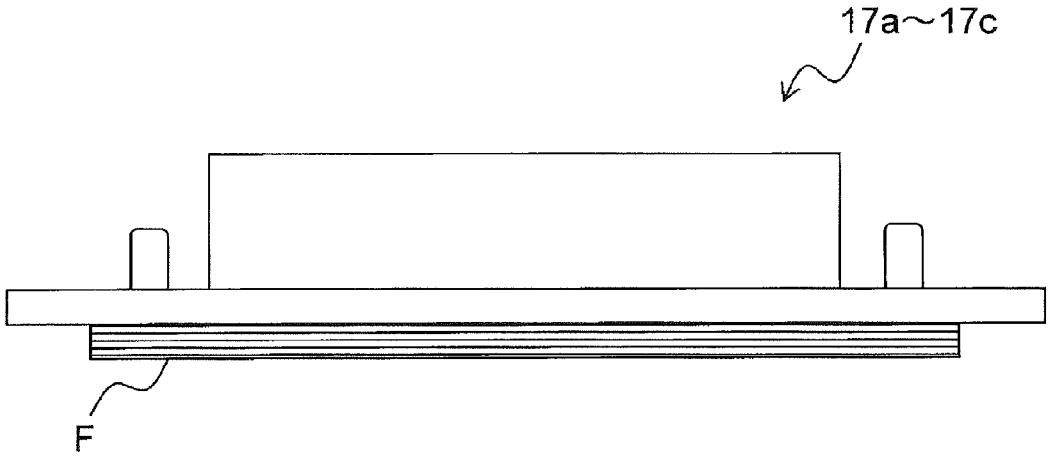
FIG. 5 illustrates a recording head constituting a line head of the recording unit of the printer according to the one embodiment in a side surface.
Figure 6:
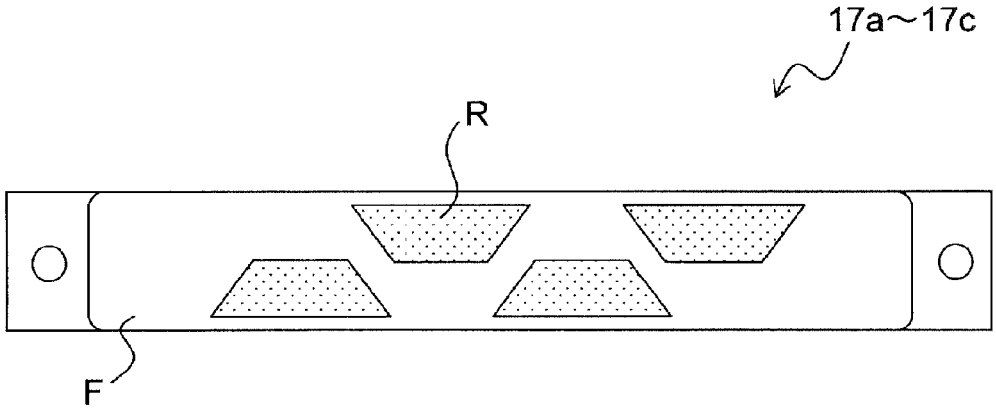
FIG. 6 illustrates the recording head of the printer according to the one embodiment from an ink discharge face side.

As illustrated in FIGS. 5 and 6, the ink discharge face F for the recording heads 17*a* to 17*c* includes nozzle regions R where multiple ink discharge nozzles 18 are arrayed. In FIGS. 5 and 6, since the recording heads 17*a* to 17*c* have the identical shape and configuration, the recording heads 17*a* to 17*c* are illustrated by one figure. As illustrated in FIGS. 3 and 4, three recording heads 17*a* to 17*c* that constitute the identical line heads 11C to 11K are arranged to have overlappings with their respective end portions such that the ink discharge nozzles 18 located in the respective recording heads 17*a* to 17*c* are partially overlapped in the paper sheet conveyance direction.

Four color (cyan, magenta, yellow, and black) inks stored in the respective ink tanks (not illustrated) are supplied to the respective recording heads 17*a* to 17*c*, which constitute the respective line heads 11C to 11K, for the respective colors of the line heads 11C to 11K.

Corresponding to the image data received from an external computer or similar unit, each of the recording heads 17*a* to 17*c* discharges ink from the ink discharge nozzle 18 toward the paper sheet P, which is conveyed while being sucked and held to the conveying surface 8*a* of the first conveyance belt 8. This forms a color image, where inks in four colors of cyan, magenta, yellow, and black are superposed, on the paper sheet P on the first conveyance belt 8.

The following describes the detailed structure in the vicinity of the end-portion position detection sensor 60 and the background member 61.

Figure 7:
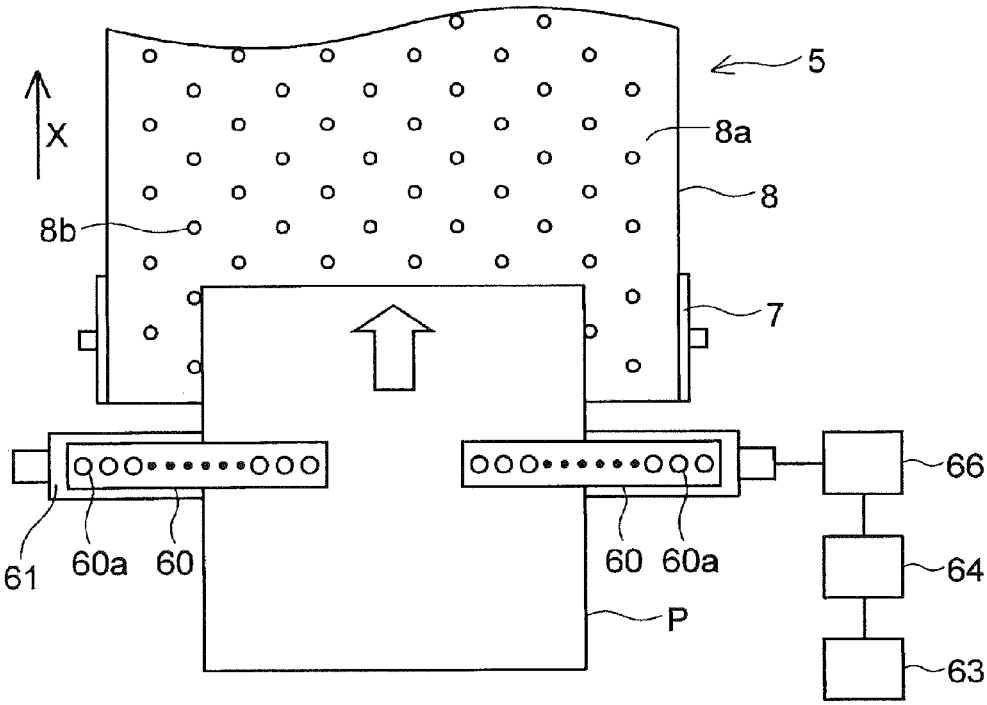
FIG. 7 illustrates a structure in a vicinity of an end-portion position detection sensor and the first belt conveying unit of the printer according to the one embodiment in a planar surface.

As illustrated in FIGS. 1 and 7, the end-portion position detection sensor 60 is arranged in the upstream of the first belt conveying unit 5 in the paper sheet conveyance direction. The background member 61 is arranged facing the detection surface (the inferior surface in FIG. 1) of the end-portion position detection sensor 60.

Figure 8:
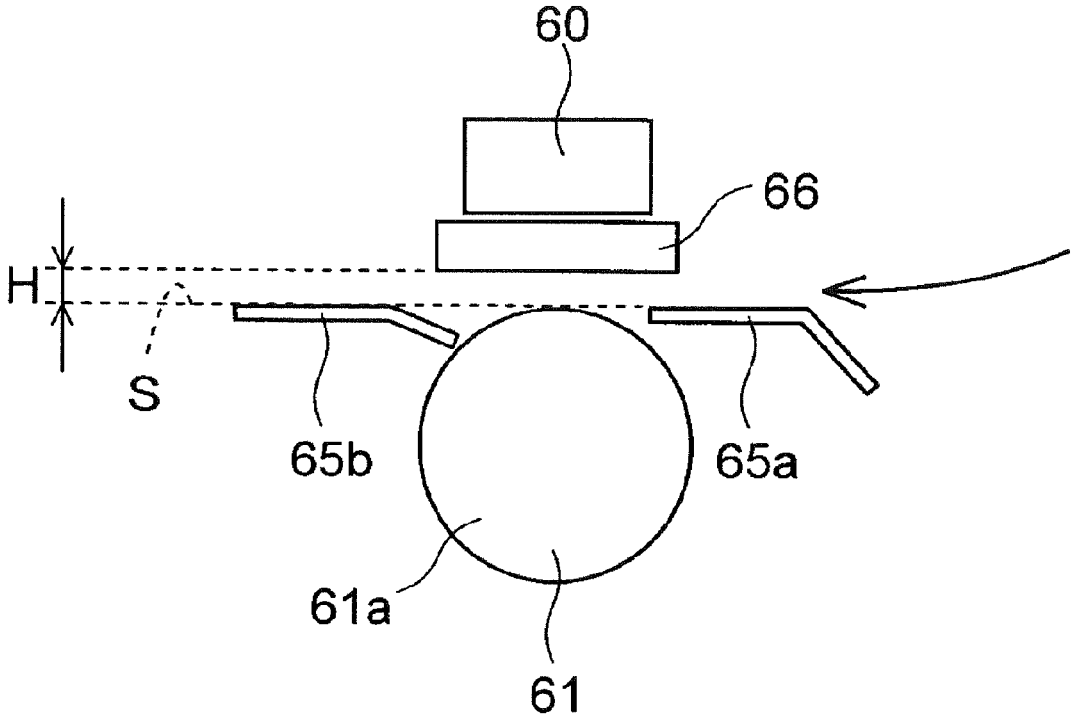
FIG. 8 illustrates a structure in a vicinity of the end-portion position detection sensor and the background member of the printer according to the one embodiment in a cross section.

As illustrated in FIG. 8, a contact glass 62 is arranged immediately below the end-portion position detection sensor 60. In the upstream and the downstream of the background member 61 in the paper sheet conveyance direction, respective conveyance guiding members 65*a* and 65*b* are arranged. Then, the inferior surface of the contact glass 62 and the top surfaces (a paper sheet conveying surface S) of the conveyance guiding members 65*a* and 65*b* form a part of the sheet conveying path. Here, the contact glass 62 is arranged at a distance of a distance H (about 2 mm) above the paper sheet conveying surface S (the top surfaces of the conveyance guiding members 65*a* and 65*b*).

As illustrated in FIG. 7, the end-portion position detection sensors 60 are formed to be shorter than the paper sheet passing region in the paper sheet width direction, and are arranged one by one on both sides of the paper sheet width direction (the lateral direction in FIG. 7). The end-portion position detection sensor 60 includes a contact image sensor where multiple detecting units 60*a* having light-emitting portions and light receiving portions are arranged in the paper sheet width direction. Then, the end-portion position detection sensor 60 detects the position of the widthwise end portion of the paper sheet P based on the intensity difference between the reflected light from the background member 61 and the reflected light from the paper sheet P. Here, the widthwise end portion of the paper sheet P is detected by the end-portion position detection sensor 60 only once for each paper sheet.

Figure 9:
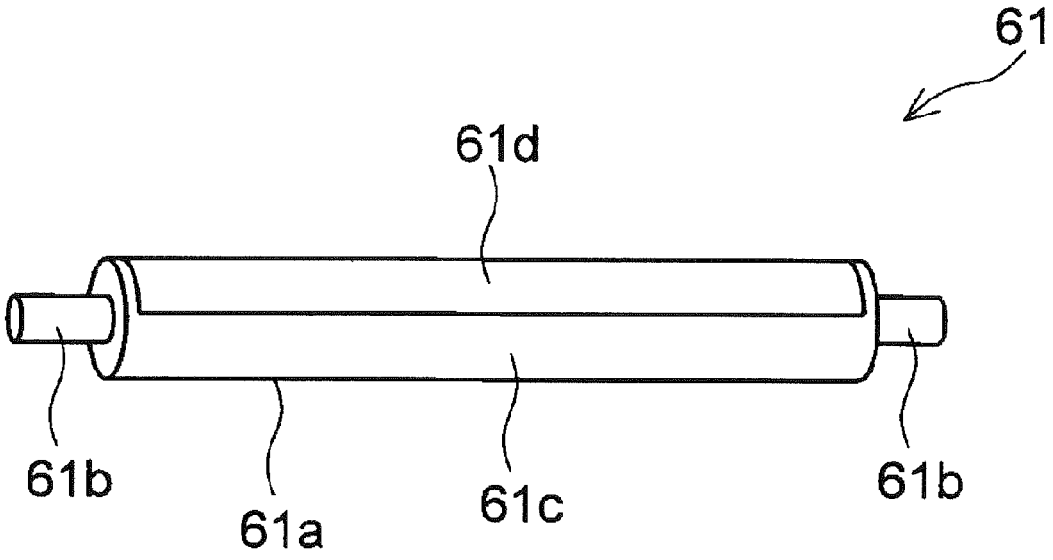
FIG. 9 illustrates a structure of the background member of the printer according to the one embodiment from an oblique side.

The background member 61 is formed to be longer than the paper sheet passing region in the paper sheet width direction, and is formed rotatably around the shaft extending along the paper sheet width direction. Specifically, as illustrated in FIG. 9, the background member 61 includes a main unit 61*a*, which extends along the paper sheet width direction, and shaft portions 61*b*, which is located on both ends of the main unit 61*a*.

The shaft portions 61*b* is, for example, rotatably supported in the printer main body 1. The background member 61 rotates around the shaft portions 61*b*.

The main unit 61*a* is formed in a solid or hollow columnar shape. Here, in this description, the columnar shape (or a polygonal columnar shape described later) is a concept including not only a solid shape but also a hollow shape. The main unit 61*a* is formed from resin or metal.

As illustrated in FIG. 8, the main unit 61*a* is arranged to have the top-most position (the position closest to the end-portion position detection sensor 60) at a height approximately identical to that of the paper sheet conveying surface S. Here, the main unit 61*a* is preferred to be arranged to have the top-most position at a height approximately identical to that of the paper sheet conveying surface S or in a position slightly lower than that of the paper sheet conveying surface S.

As illustrated in FIG. 9, on the outer peripheral surface of the main unit 61*a*, at least in the region facing the end-portion position detection sensor 60, two regions 61*c* and 61*d*, which have mutually different colors and extend in the paper sheet width direction, are formed circumferentially dividing the outer peripheral surface. The region 61*c* is formed to be, for example, white so as to have a high intensity (a high reflectivity) of the reflected light. The region 61*d* is formed to be, for example, black so as to have a low intensity (a low reflectivity) of the reflected light.

For example, the region 61*c* may be formed using the color of the material of the substrate forming the main unit 61*a*. That is, the region 61*c* may be a non-painted region where the outer peripheral surface of the substrate made of white-colored resin forming the main unit 61*a* is not painted. The region 61*d* may be colored by painting the outer peripheral surface of the main unit 61*a*. That is, the region 61*d* may be a painted region where the outer peripheral surface of the main unit 61*a* is painted in a color different from that of the substrate.

Here, both the regions 61*c* and 61*d* may be painted regions. Alternatively, the regions 61*c* and 61*d* may be formed not by painting but by attaching the sheet material such as a resin film having a predetermined color to the outer peripheral surface of the main unit 61*a*.

As illustrated in FIG. 7, the background member 61 receives a rotary drive power transmitted from a rotary driving unit 66 via a transmission gear or similar member (not illustrated). The rotary driving unit 66 includes a driving motor and similar member, and is configured to receive the signal from a control unit 64, which is electrically connected to a paper sheet sensor (a recording medium sensor) 63. Here, the control unit 64 controls the overall operation of the printer 100.

The paper sheet sensor 63 is constituted of a media sensor, which detects the reflectivity of the paper sheet P, or a color sensor, which detects the color of the paper sheet P, and outputs the detection result to the control unit 64. The paper sheet sensor 63 only needs to be arranged in the upstream of the end-portion position detection sensor 60 in the paper sheet conveyance direction, and is arranged, for example, in the vicinity of the registration roller pair 13 (in the joining portion between the first paper sheet conveyance passage 4*a* and the reverse conveyance path 16). Here, the paper sheet sensor 63 only needs to detect, for example, one point (or one region) of the paper sheet P, differently from the end-portion position detection sensor 60.

The control unit 64 drives the rotary driving unit 66 corresponding to the detection result of the paper sheet sensor 63, and rotates the background member 61 by a predetermined angle until the paper sheet P is conveyed onto the background member 61. Specifically, when the control unit 64 determines that the reflectivity of the paper sheet P is high (the intensity of the reflected light from the paper sheet P is high) based on the detection result of the paper sheet sensor 63, the control unit 64 rotates the background member 61 to turn the region 61*d* toward the end-portion position detection sensor 60 side (the upper side) so as to decrease the intensity of the reflected light from the background member 61. On the other hand, when the control unit 64 determines that the reflectivity of the paper sheet P is low (the intensity of the reflected light from the paper sheet P is low) based on the detection result of the paper sheet sensor 63, the control unit 64 rotates the background member 61 to turn the region 61*c* toward the end-portion position detection sensor 60 side so as to increase the intensity of the reflected light from the background member 61. As just described, the color of the portion facing the detection surface of the end-portion position detection sensor 60 in the background member 61 is changed. This reduces the decrease in intensity difference between the reflected light from the background member 61 and the reflected light from the paper sheet P regardless of the reflectivity or the color of the paper sheet P. The control unit 64 is configured not to rotate the background member 61 during the period while the paper sheet P is passing over the background member 61. Here, a detecting unit that detects the rotation amount of the background member 61 may be disposed.

The control unit 64 is electrically connected also to the end-portion position detection sensor 60 and the recording unit 9. When the control unit 64 receives the detection result of the end-portion position detection sensor 60, the control unit 64 derives the size and the position shift of the paper sheet P from the detection result to discharge ink from the ink discharge nozzle 18 corresponding to the printing region of the paper sheet P.

The following describes demonstration experiments that were carried out to demonstrate the effects of this embodiment. These demonstration experiments were carried out in Working examples 1 and 2 corresponding to the above-described embodiment and Comparative example 1.

WORKING EXAMPLE 1

The region 61*d* in black color was formed by attaching Lumilar (registered trademark) in black color to the outer peripheral surface of the main unit 61*a* of the background member 61. Then, the region 61*d* was arranged facing the end-portion position detection sensor 60 side (the upper side). The paper sheet P in white color passed through the position between the end-portion position detection sensor 60 and the background member 61. The other configurations in Working example 1 were similar to those in the above-described embodiment.

WORKING EXAMPLE 2

The main unit 61 a was formed using a substrate made of white-colored resin, and the region 61 c in white color was formed using the color of the material of the substrate. Then, the region 61*c* was arranged facing the end-portion position detection sensor 60 side (the upper side). The paper sheet P in dark grey color passed through the position between the end-portion position detection sensor 60 and the background member 61. The other configurations in Working example 2 were similar to those in Working example 1.

COMPARATIVE EXAMPLE 1

The region 61*d* in black color was formed by attaching Lumilar (registered trademark) in black color to the outer peripheral surface of the main unit 61*a*. Then, the region 61*d* was arranged facing the end-portion position detection sensor 60 side (the upper side). The paper sheet P in dark grey color passed through the position between the end-portion position detection sensor 60 and the background member 61. The other configurations in Comparative example 1 were similar to those in Working example 1.

Then, regarding Working examples 1 and 2 and Comparative example 1, the reflected light intensity detected by the end-portion position detection sensor 60 was measured. The respective results of this measurement are illustrated in FIGS. 10, 11, and 12.

Figure 10:
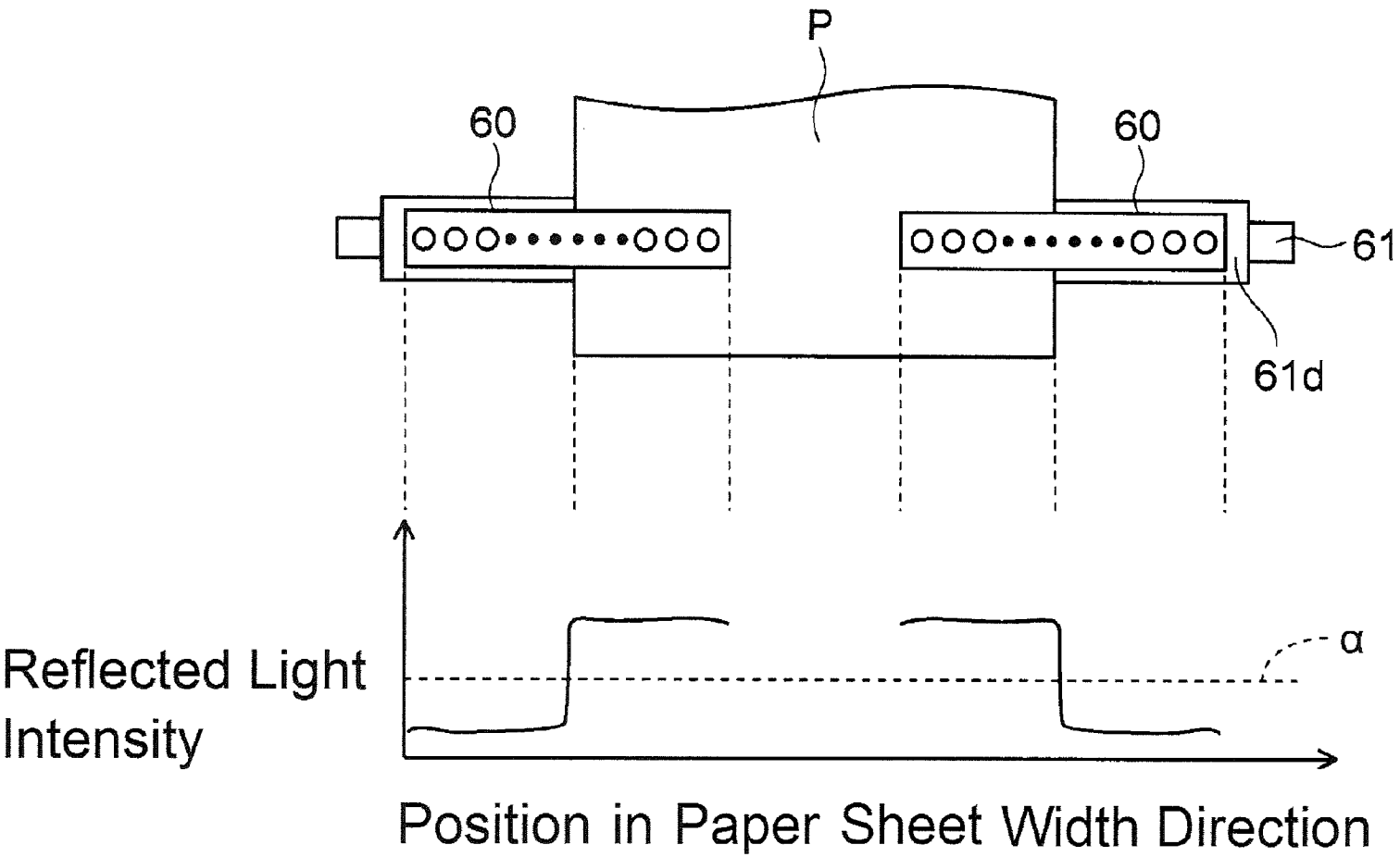
FIG. 10 illustrates a measurement result of a reflected light intensity detected by the end-portion position detection sensor in Working example 1.

In Working example 1, as illustrated in FIG. 10, the reflected light intensity from the black-colored region 61*d* of the background member 61 was lower than a threshold value α, and the reflected light intensity from the white-colored paper sheet P was higher than the threshold value α. Accordingly, the position of the widthwise end portion of the paper sheet P was able to be detected based on the change point (the position where the reflected light intensity crossed the threshold value α) of the reflected light intensity.

Figure 11:
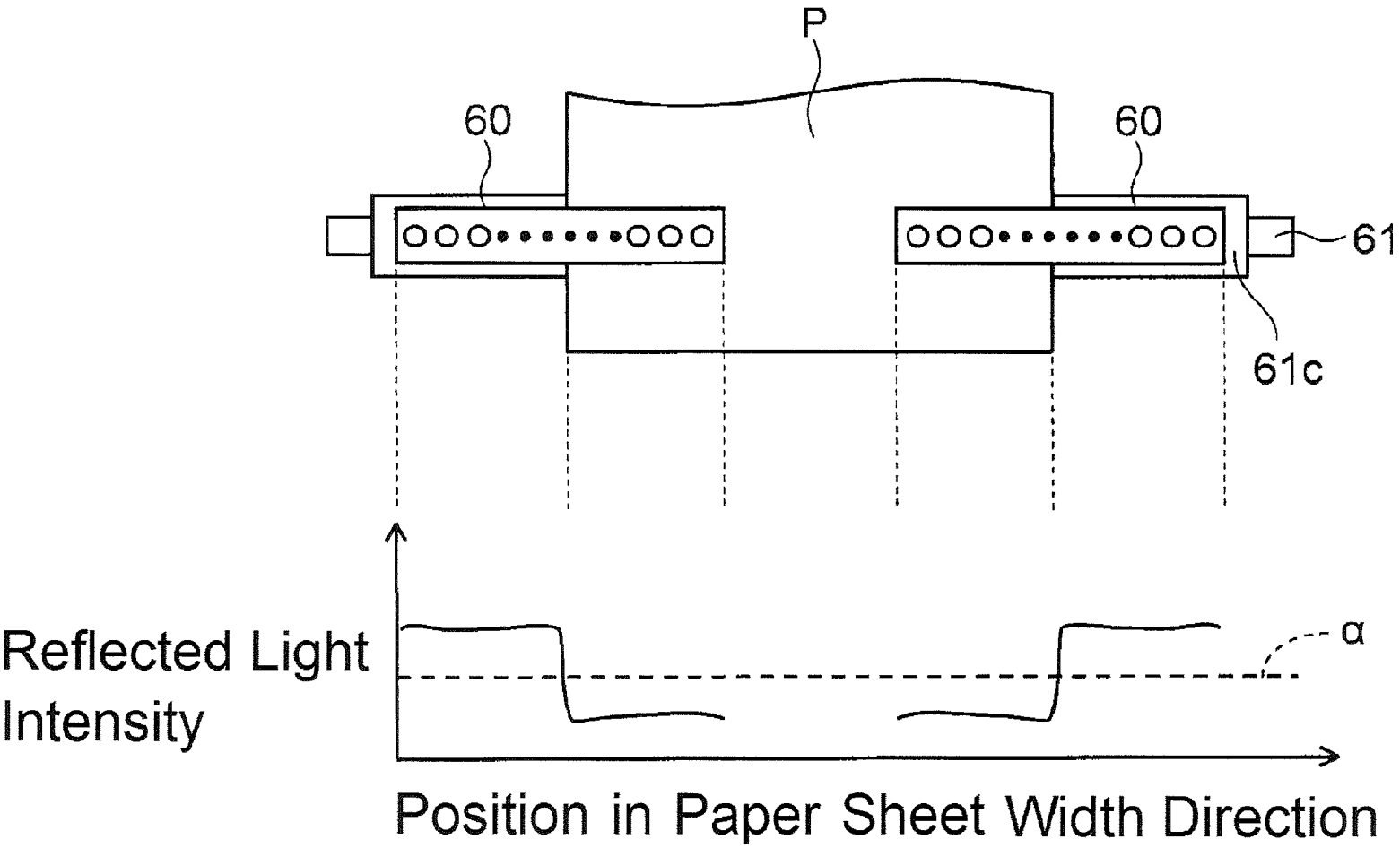
FIG. 11 illustrates a measurement result of a reflected light intensity detected by the end-portion position detection sensor in Working example 2.

In Working example 2, as illustrated in FIG. 11, the reflected light intensity from the white-colored region 61*c* of the background member 61 was higher than the threshold value α, and the reflected light intensity from the dark-gray paper sheet P was lower than the threshold value α. Accordingly, the position of the widthwise end portion of the paper sheet P was able to be detected based on the change point (the position where the reflected light intensity crossed the threshold value α) of the reflected light intensity.

Figure 12:
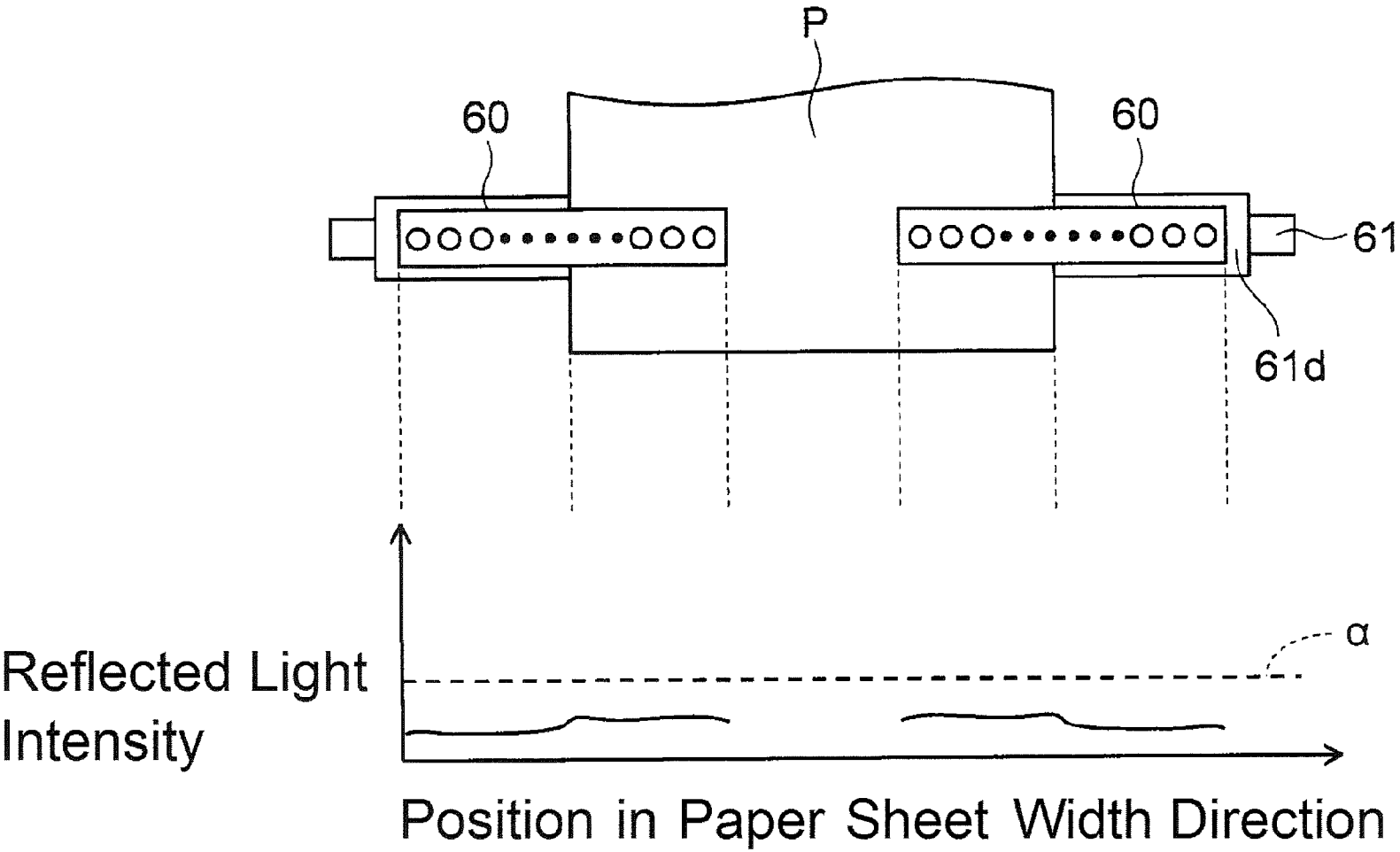
FIG. 12 illustrates a measurement result of a reflected light intensity detected by the end-portion position detection sensor in Comparative example 1.

In Comparative example 1, as illustrated in FIG. 12, the reflected light intensity from the black region 61*d* of the background member 61 was lower than the threshold value α, and the reflected light intensity from the dark-gray paper sheet P was also lower than the threshold value α. Accordingly, the change in reflected light intensity was small and the reflected light intensity did not cross the threshold value α. Thus, the position of the widthwise end portion of the paper sheet P could not be detected.

As described above, this embodiment includes the end-portion position detection sensor 60, which detects the position of the widthwise end portion of the paper sheet P using the reflected light, and the background member 61, which is arranged facing the detection surface of the end-portion position detection sensor 60. Accordingly, the position of the widthwise end portion of the paper sheet P is detected based on the intensity difference between the reflected light from the background member 61 and the reflected light from the paper sheet P.

Then, on the outer peripheral surface of the background member 61, at least in the region facing the detection surface of the end-portion position detection sensor 60, the two regions 61*c* and 61*d* having mutually different colors are formed to circumferentially divide the outer peripheral surface. As necessary, the background member 61 rotates to change the region facing the detection surface of the end-portion position detection sensor 60 in the background member 61. This reduces the decrease in intensity difference between the reflected light from the background member 61 and the reflected light from the paper sheet P regardless of the reflectivity or the color of the paper sheet P. Accordingly, the position of the widthwise end portion of the paper sheet P can be accurately detected.

As described above, the paper sheet sensor 63, which detects the reflectivity or the color of the paper sheet P, is disposed. Accordingly, based on the reflectivity or the color of the paper sheet P, the color of the portion facing the detection surface of the end-portion position detection sensor 60 in the background member 61 can be automatically changed. This simply reduces the decrease in intensity difference between the reflected light from the background member 61 and the reflected light from the paper sheet P. Accordingly, the position of the widthwise end portion of the paper sheet P can be simply and accurately detected.

As described above, the region 61*c* may be a non-painted region where the outer peripheral surface of the substrate made of white-colored resin forming the main unit 61*a* is not painted. The region 61*d* may be a painted region where the outer peripheral surface of the main unit 61*a* is painted in a color different from that of the substrate. With this configuration, the non-painted region (the region 61*c*) can be formed using the color of the material of the substrate. Thus, the structure of the background member 61 can be simple. Additionally, the region 61*d* can be formed in a color different from that of the non-painted region (the region 61*c*) by painting. Thus, the background member 61 can be simply formed.

As described above, for example, the black-colored region 61*d* and the white-colored region 61*c* are formed on the outer peripheral surface of the background member 61. Accordingly, for example, by turning the black-colored region 61*d* of the background member 61 toward the end-portion position detection sensor 60 side when the paper sheet P is white and turning the white-colored region 61*c* of the background member 61 toward the end-portion position detection sensor 60 side when the paper sheet P is black or dark-gray, the decrease in intensity difference between the reflected light from the background member 61 and the reflected light from the paper sheet P can be simply reduced.

As described above, when the manual paper feed tray 2*b* on which the paper sheets P in a plurality of sizes are placeable is used, paper sheets in various sizes are supplied. Accordingly, it is particularly effective to accurately detect the position of the widthwise end portion of the paper sheet using the disclosure.

For example, in the above-described embodiment, a description is given of the example where the white-colored region 61*c* and the black-colored region 61*d* are formed on the outer peripheral surface of the main unit 61*a* of the background member 61. However, the disclosure is not limited to this, and these regions may be formed in colors other than white and black. For example, the region 61*c* may be in a metal color instead of white color. In this case, the main unit 61*a* may be formed of metal as the region 61*c* without paining the outer peripheral surface of the main unit 61*a*. For example, the region 61*d* may be formed in a color such as dark grey with a low reflectivity.

While in the above-described embodiment a description is given of the example where only two regions having mutually different colors are formed on the outer peripheral surface of the main unit 61*a* of the background member 61, the disclosure is not limited to this. Three or more regions having mutually different colors may be located on the outer peripheral surface of the main unit 61*a*. At this time, three regions in red, green, and blue as three primary colors may be disposed. Alternatively, four regions in red, green, blue, and black may be disposed.

Figure 13:
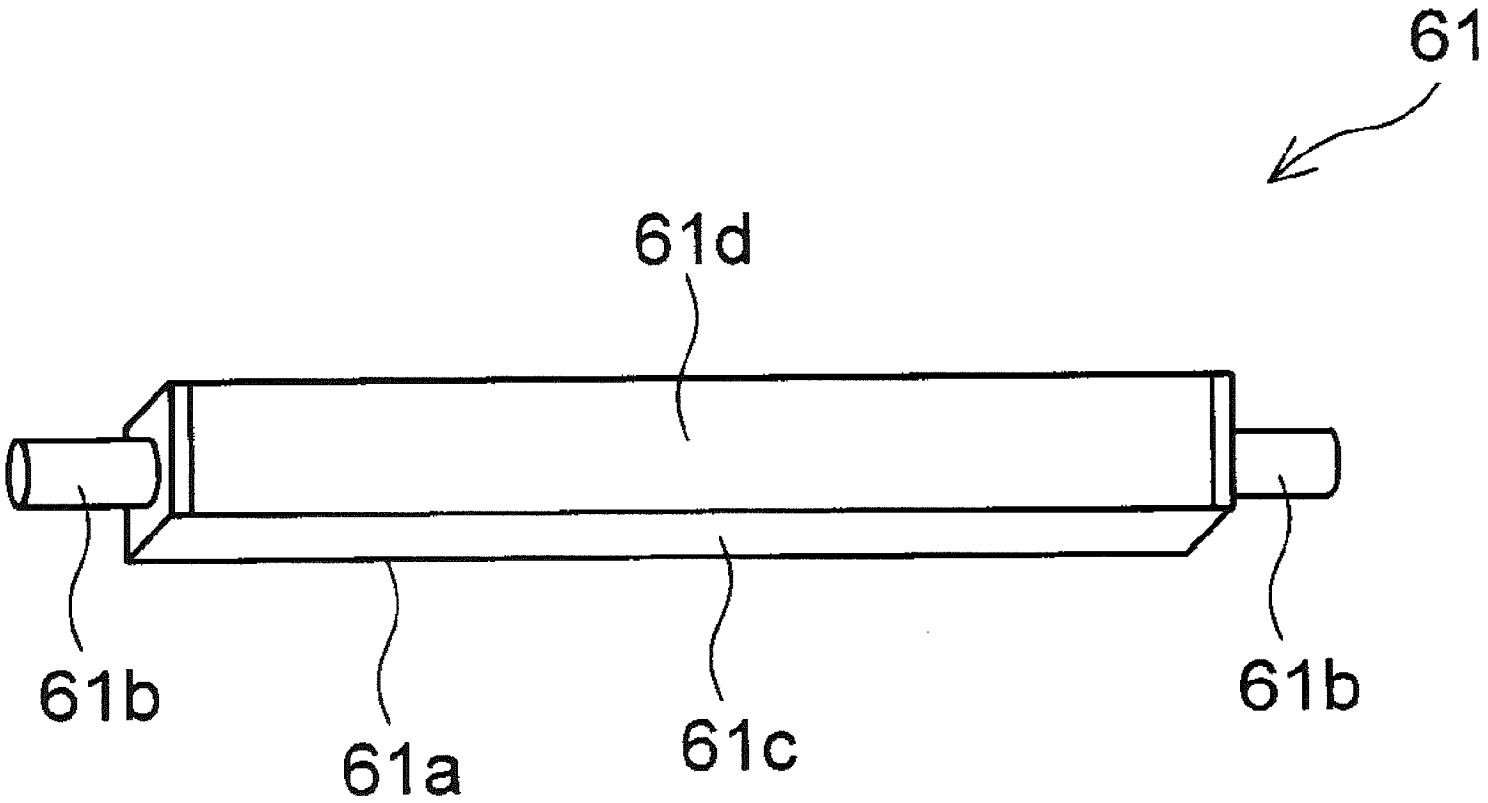
FIG. 13 illustrates the structure of a background member according to a modification of the disclosure from an oblique side.

While in the above-described embodiment a description is given of the example where the main unit 61 a of the background member 61 is formed in a columnar shape, the disclosure is not limited to this, and the main unit 61*a* may be formed in a polygonal columnar shape. For example, like the background member 61 according to a modification of the disclosure illustrated in FIG. 13, the main unit 61*a* may be formed, for example, in a quadrangular prism shape. When the main unit 61*a* is formed in a polygonal columnar shape, regions having mutually different colors may be formed on the respective surfaces.

While in the above-described embodiment a description is given of the example where a contact image sensor is used as the end-portion position detection sensor 60, which detects the position of the end portion of the paper sheet P, a sensor such as a CCD other than the contact image sensor may be used.

While in the above-described embodiment a description is given of the example where the paper sheet sensor 63, which detects the reflectivity or the color of the paper sheet P, is disposed and the background member 61 automatically rotates corresponding to the detection result of the paper sheet sensor 63, the disclosure is not limited to this. For example, without the paper sheet sensor 63, the user may input the color or similar parameter of the paper sheet P to an operation panel (not illustrated) or similar member of the printer 100 so as to cause the control unit 64 to rotate the background member 61. Alternatively, a printer driver installed on a personal computer or similar member can be used to specify (input) the color of the paper sheet used for printing. With this configuration, when print data is transmitted from the personal computer or similar member to the printer 100, the control unit 64 may reference the data related to the color of the paper sheet included in the print data and the control unit 64 may rotate the background member 61.

While in the above-described embodiment a description is given of the effectiveness of the disclosure when the color of the paper sheet P is black or dark-grey, the disclosure is effective also when, for example, an edged paper sheet is used as the paper sheet P.

While in the above-described embodiment a description is given of the example where the end-portion position detection sensor 60 is located on both sides in the paper sheet width direction, the end-portion position detection sensor 60 may be located only on one side in the paper sheet width direction in the case of a printer (an ink-jet recording apparatus) using only a fixed-size paper sheet. This configuration can save the cost.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An ink-jet recording apparatus, comprising:

a belt conveying unit including a conveyance belt to convey a recording medium;

a recording unit arranged facing the belt conveying unit, the recording unit discharging ink to the recording medium conveyed by the belt conveying unit;

an end-portion position detection sensor arranged in an upstream of the belt conveying unit in a recording medium conveyance direction, the end-portion position detection sensor using a reflected light to detect a position of an end portion of the recording medium in a recording medium width direction intersecting with the recording medium conveyance direction;

a background member arranged facing a detection surface of the end-portion position detection sensor, the background member being rotatable around a shaft extending along the recording medium width direction;

a rotary driving unit that rotates the background member; and a recording medium sensor that detects a reflectivity or a color of the recording medium, wherein the background member has an outer peripheral surface at least in a region facing the detection surface of the end-portion position detection sensor, the outer peripheral surface having two or more regions having mutually different colors circumferentially dividing the outer peripheral surface, and wherein the rotary driving unit rotates the background member corresponding to a detection result of the recording medium sensor to change the region facing the detection surface of the end-portion position detection sensor in the background member such that an intensity difference between a reflected light from the background member and a reflected light from the recording medium increases.

* * * * *